US005399059A

United States Patent [19]

Simpson

[11] Patent Number: 5,399,059

[45] Date of Patent: Mar. 21, 1995

[54] OVERHEAD SUPPORT FRAME ASSEMBLY FOR VEHICLE

[75] Inventor: Clark C. Simpson, Martin, Mich.

[73] Assignee: Clark Material Handling Company, Lexington, Ky.

[21] Appl. No.: 181,486

[22] Filed: Jan. 13, 1994

Related U.S. Application Data

[63] Continuation of Ser. No. 61,915, May 14, 1993, abandoned, which is a continuation of Ser. No. 702,921, May 20, 1991, abandoned, which is a continuation of Ser. No. 495,619, Mar. 19, 1990, abandoned.

[51] Int. Cl.[6] ..... B66F 9/00

[52] U.S. Cl. ..... 414/635; 414/914

[58] Field of Search ..... 414/631-638, 414/914, 639; 296/102, 190; 280/756

[56] References Cited

U.S. PATENT DOCUMENTS

| | | | |
|---|---|---|---|
| 4,067,393 | 1/1978 | Szarkowski | 414/914 X |
| 4,289,442 | 9/1981 | Stevens | 414/631 X |
| 4,325,464 | 4/1982 | Larsson | 414/631 X |
| 4,496,031 | 1/1985 | Allen et al. | 414/631 X |
| 4,949,816 | 8/1990 | Brown et al. | 414/631 X |

FOREIGN PATENT DOCUMENTS

| | | | |
|---|---|---|---|
| 1945935 | 3/1971 | Germany | 296/102 |
| 2065376 | 12/1980 | Germany | 296/190 |

*Primary Examiner*—David A. Bucci

[57] ABSTRACT

An overhead support frame assembly provides enhanced strength for an attachment for the vehicle or the like, and features minimum obstruction of vision from the driver station. The frame assembly has a pair of laterally spaced frame units; each including an interconnected tower support plate, overhead extension plate, and upstanding support post. The base of each tower support plate is attached to the vehicle deck at an approximate 30° angle to the longitudinal axis of the vehicle and slanted forwardly toward the horizontal overhead extension plate at an approximate 10° angle. The position and angle of the tower support plates provide a 60° unobstructed rear view from the driver station. Each extension plate is directed to the front of the vehicle and terminates at the upper end of an upstanding support post positioned adjacent to the driver station for secondary support. Front and rear cross beams extend between the upper ends of the secondary support posts and the tower support plates, respectively. The frame units and cross beams form the substantially rigid support frame assembly with increased strength in both the compression/tension modes, and especially adapted for mounting overhead cylinders for a forklift attachment. The arrangement also provides an extended lateral opening for unobstructed side engine access and a substantially unobstructed view to the sides of the vehicle.

8 Claims, 3 Drawing Sheets

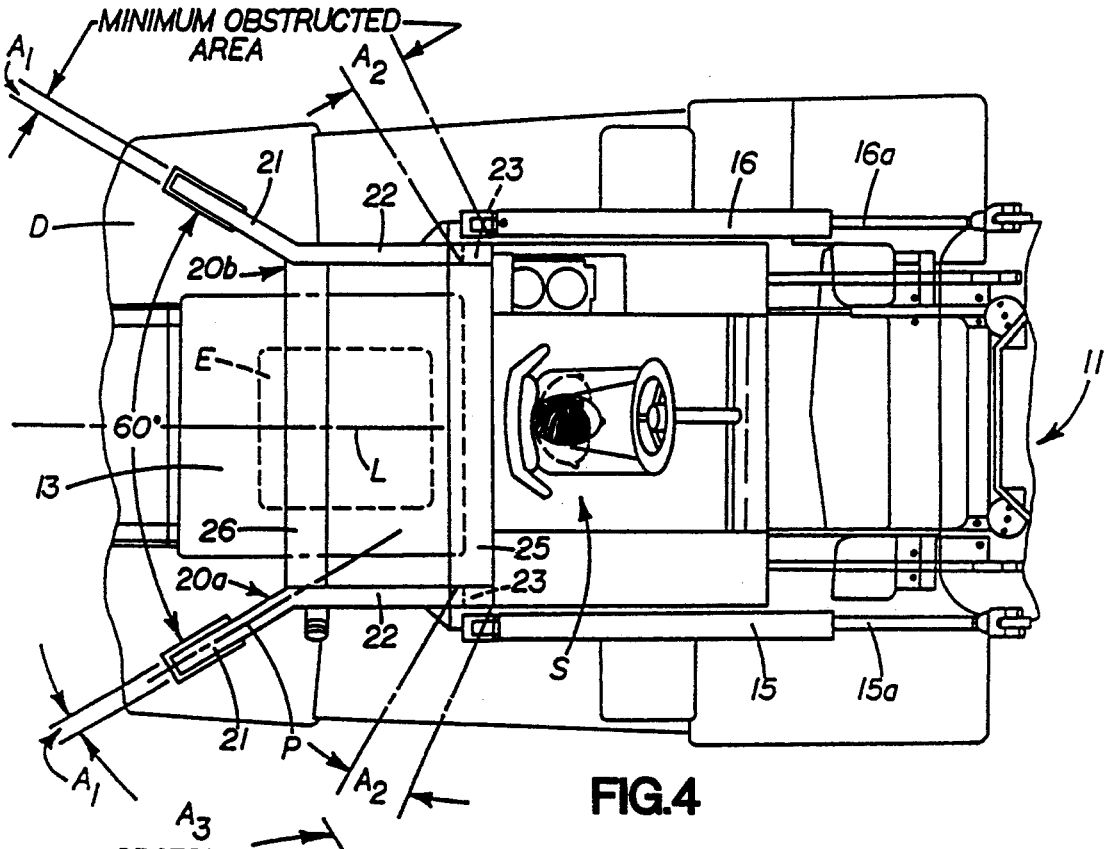
FIG.4
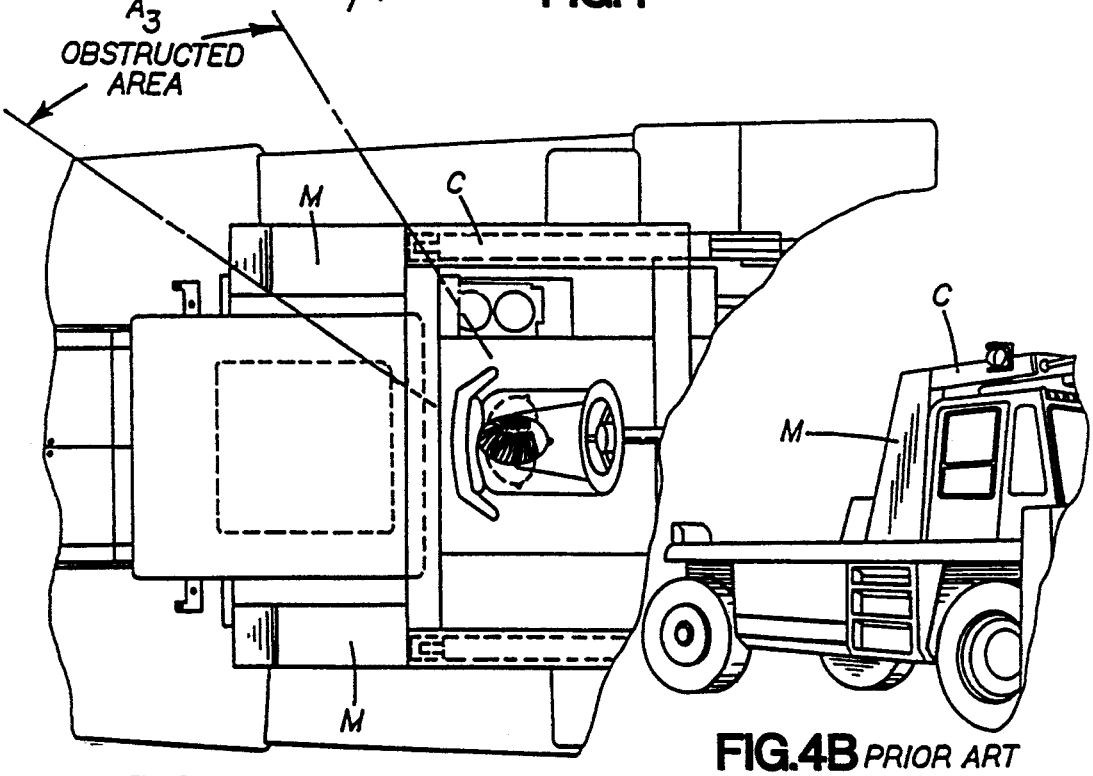
FIG.4A PRIOR ART
FIG.4B PRIOR ART

OVERHEAD SUPPORT FRAME ASSEMBLY FOR VEHICLE

This application is a continuation of application Ser. No. 08/061,915, filed May 14, 1993, now abandoned, which application is a continuation of application Ser. No. 07/702,921, filed May 20, 1991, now abandoned, which is a continuation of application Ser. No. 07/495,619, filed Mar. 19, 1990, now abandoned.

BACKGROUND OF THE INVENTION

The present invention relates to industrial vehicles, and more particularly, to a vehicle requiring an overhead support, such as for tilt cylinders in a heavy duty forklift vehicle.

In industrial vehicles, it is sometimes necessary to provide overhead structural support for an attachment. For example, in the forklift vehicle environment, it is recognized that there is an advantage to provide overhead tilt cylinders for the front mounted, forklift attachment. With the overhead cylinders, better control of the tilting of the attachment can be achieved. The overhead positioning of the cylinders allows the piston rod to be attached to an intermediate point along the support structure of the vertically extending forklift attachment. This provides a better point of attachment in that the cylinder can be mounted substantially horizontally, and thus provide superior force application.

This is particularly important in operation of the cylinders to tilt the forklift attachment toward or away from the vehicle as heavy loads are lifted, especially from high, overhead positions. If the cylinders are mounted low on the deck of the vehicle, it requires greater pulling/pushing power (because of the reduced effective lever arm) to tilt the forklift attachment under the same loading. Positioning the cylinders overhead provides better control, since less power is required and better stability as the vehicle is moved, especially with the load in the overhead position.

A side benefit of overhead cylinder mounting is that there is provided falling object protective structure (FOPS) without providing additional, unnecessary passive structure, that would otherwise simply add cost and weight to the vehicle. The supporting structure for the overhead cylinders performs the secondary FOPS function adding substantially to the cost/benefit ratio for the vehicle.

In the past, the manufacturers have relied generally on providing a singular, generally vertical tower support or post on each side of the vehicle for mounting the tilt cylinders. The tower supports are connected by a single, overhead cross beam with the base of the tilt cylinders being attached to the top of the towers. In terms of structural support for the cylinders and FOPS efficiency in the immediate area of the driver station, this prior arrangement has proven to be satisfactory.

However, in order to give the cylinders proper mounting support, these tower structures of the prior art have necessarily been relatively massive in size. The tower supports are fabricated of heavy gauge steel in the form of a tapering box cross section. The front of the box is designed to be substantially vertical in order to fit immediately behind the cab surrounding the driver station, with the back of the tower support being tapered from top to bottom. The cross section of the tower support is designed to be greater at the base than at the top. This is due to the increased moment of force generated by compression/tension in the overhead mounting cylinders acting on the overhead support as the load is picked up by the forks.

Also, by tapering the tower supports, the visibility to the rear and sides of the vehicle is kept as open as possible commensurate with the requirement for strength to support the cylinders. While state of the art warning devices for backing vehicles, improved driver station positioning and improved deck configurations have provided good visibility in the past, continuing to improve commensurate with good structural design is desirable. This need for still further improvement applies especially to the manner of supporting the overhead tilt cylinders, in a heavy duty forklift vehicle, as will be seen in detail below as the description of the preferred embodiment of the present invention develops.

SUMMARY OF THE INVENTION

Accordingly, it is a primary object of the present invention to provide a support frame assembly for a vehicle, such as a forklift vehicle, having enhanced strength for improved support for attachments, such as the forklift attachment.

It is another object of the present invention to provide an overhead support frame assembly for a vehicle wherein the frame assembly provides minimum obstruction of the rear/side vision for the driver positioned at the driver station of the vehicle.

It is another object of the present invention to provide an overhead support frame assembly wherein the main tower support means extends rearwardly of the vehicle and defines a plane passing through the driver station to provide substantially unobstructed rear view from the driver station.

It is still another object of the present invention to provide an overhead support frame assembly, overhead extension plate and cross beams providing improved falling object protective structure (FOPS).

It is still another object of the present invention to provide an overhead support frame assembly for anchoring an attachment for a vehicle, wherein the frame assembly is positioned to provide easy access for a rear mounted engine of the vehicle.

A further object of the present invention is to provide a support frame assembly for a vehicle including overhead frame units with cross beams having sufficient strength to accommodate mounting of hydraulic cylinders for tilting a forklift attachment of the vehicle.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described, an improved overhead support frame assembly for a vehicle is provided. A tower support means is positioned to the rear of the driver station and provides primary support of the assembly. An overhead extension attached to the upper end of the tower support is directed toward the front of the vehicle and terminates adjacent the driver station. An upstanding support post is connected to the extension for secondary support. The frame assembly thus constructed provides enhanced strength for supporting attachments and the like for the vehicle as will be set forth in greater detail below.

The tower support means defines a plane directed substantially toward the driver station, that is the plane extending through the tower support means passes through the driver's station. The obstruction of the rear/side vision for the driver is thereby minimized since there is minimum thickness along the line of sight of the driver in the direction of the rear/side of the vehicle. The upstanding support posts that provide secondary support are also of minimum thickness and at the corner of the cab defining the driver station thereby also providing a minimum obstructed area for the driver's vision to the side.

The tower support means is preferably formed of an elongated, heavy gauge steel plate extending at an approximate 30° angle to the longitudinal axis of the vehicle. In addition, the tower support plate slants forwardly toward the front of the vehicle at an approximate 10° angle.

The overhead extension means is also formed of an elongated, heavy gauge steel plate. In the preferred embodiment of the frame assembly, a pair of frame units, one on each side of the vehicle, is provided; each frame unit including a tower support plate, an extension plate and an upstanding support post. The two frame units are tied together overhead by front and rear cross beams. The frame assembly so constructed provides enhanced falling object protective structure (FOPS).

The overhead support frame assembly constructed of the pair of frame units as described, provides enhanced strength for supporting an attachment for the vehicle, such as the tilt cylinders for a forklift attachment. Repositioning the primary tower support plate toward the rear and utilizing a secondary support post for each frame unit, results in a wider support footprint, and thus wider distribution of the force and greater strength and stability. Also, increased strength is provided by the heavy gauge steel plates that are used for the tower support and the overhead extension, as opposed to a massive box beam for the single tower structure. The force moment in the frame units is also reduced by transmitting the primary force to the rear tower support plate and angling the plate at a 10° forward slant.

In a vehicle having a rear mounted engine, the space between the tower support plate and the support post provides open access for easy engine accessibility. To the rear of the vehicle, a full 60° opening is provided, for both engine accessibility and maximum visibility from the driver station.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate the several aspects of the present invention and together with the description serve to explain the principles of the invention. In the drawings:

FIG. 4 is a top plan view of the vehicle with the cab removed and portions broken away and showing the overhead support frame assembly from above;

FIG. **4*a* is a smaller perspective view with a portion broken away of the prior art vehicle embodying the concept of a massive, single tower support on each side of the vehicle for the overhead cylinders; and FIG. 4*b*** is a top view of the prior art vehicle and showing the obstructed area inherent in the massive, single tower support concept of the prior art.

Reference will now be made in detail to the present preferred embodiment of the invention, an example of which is illustrated in the accompanying drawings.

DETAILED DESCRIPTION OF THE INVENTION

Figure 1:
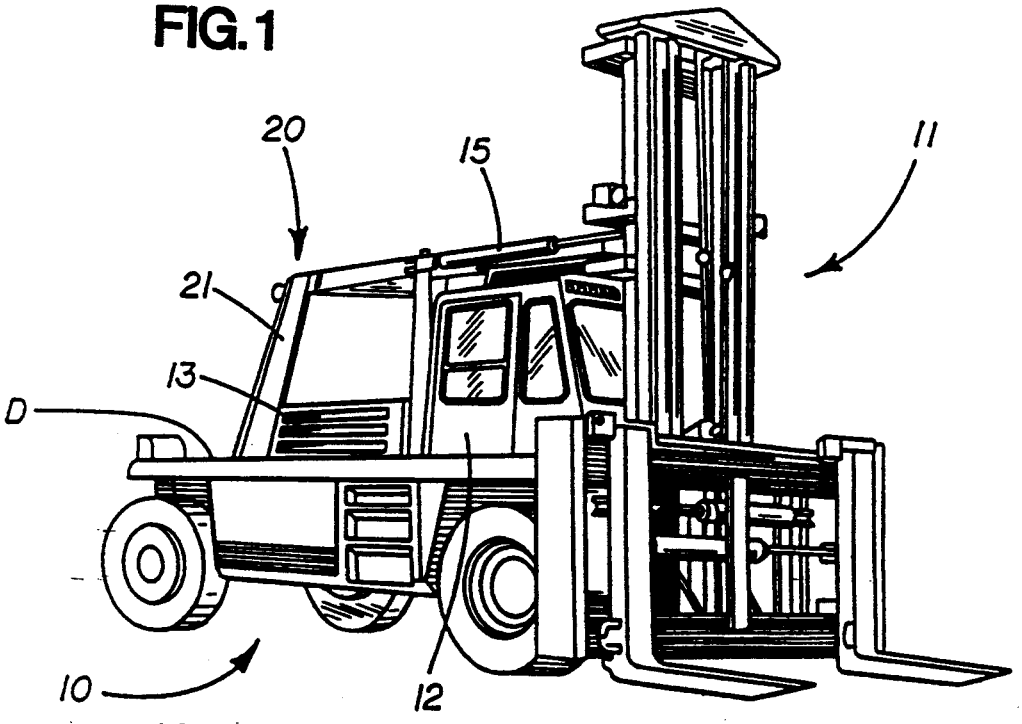
FIG. 1 is a side perspective view of a vehicle with a forklift attachment and the overhead support frame assembly anchoring the tilt cylinders in accordance with the present invention.
Figure 2:
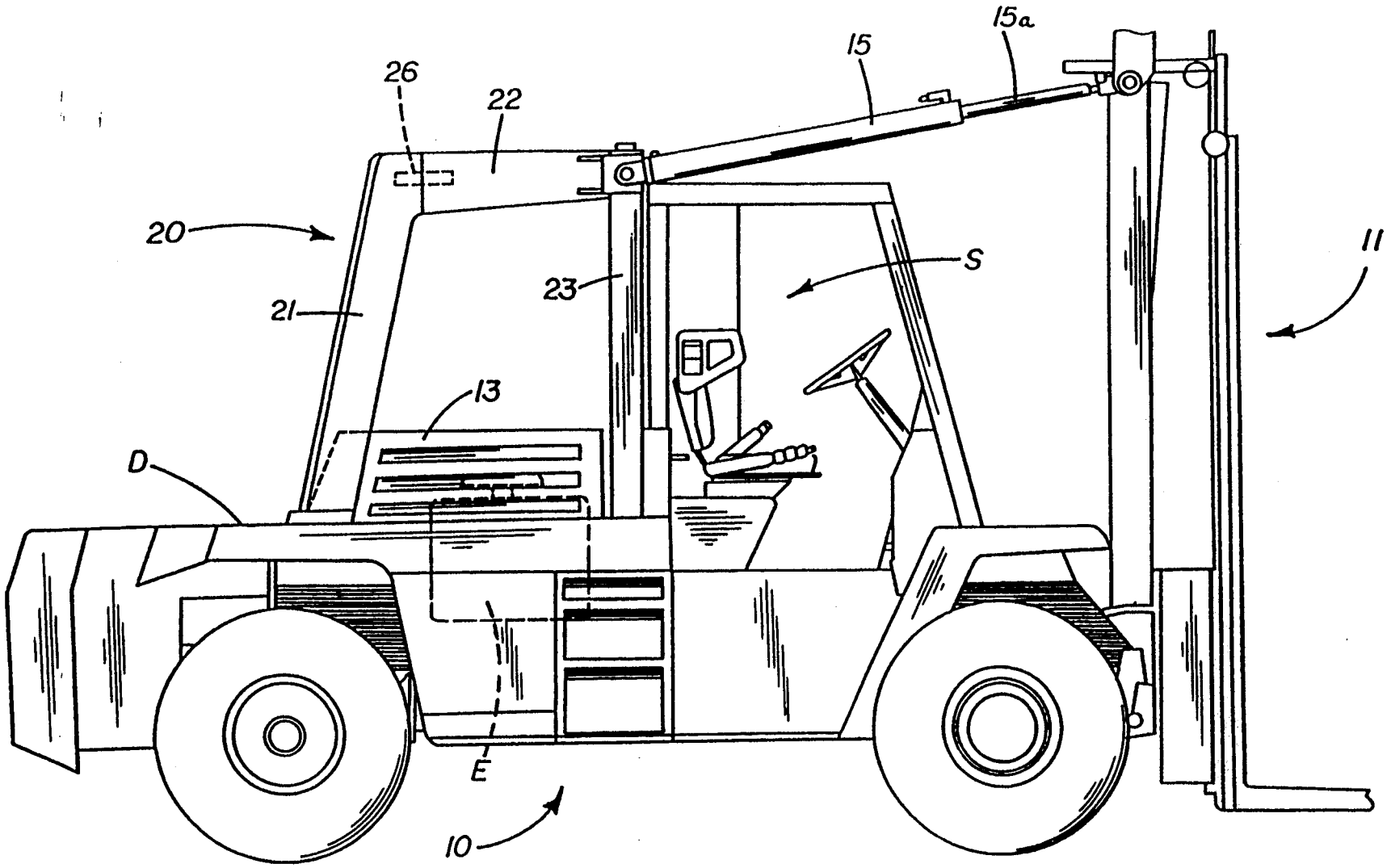
FIG. 2 is a side elevational view with the cab removed and enlarged to show in greater detail the overhead support frame assembly of the present invention.

With reference now to FIGS. 1 and 2 of the drawings, there is shown a vehicle 10, namely a heavy duty forklift vehicle, with a front mounted forklift attachment 11. The vehicle includes a cab 12 that defines a driver station S of the vehicle and a rear mounted engine E covered by a cowling 13.

The forklift vehicle 10 is of the type having overhead power cylinders 15, 16 (see FIG. 4) for controlling the tilt of the attachment 11. The centrally located driver station S is positioned just forwardly of the engine E, which can best be seen FIG. 2. The piston rods **15*a*, 16*a* are connected at intermediate points along the sides of the forklift attachment 11** so as to provide the tilting function.

In accordance with the present invention, to anchor the rear of the tilt cylinders 15, 16, an improved overhead support frame assembly 20 is designed for enhanced strength in either the compression mode when the attachment 11 is tilted backwardly, or the tension mode when tilted forwardly. Secondly, the frame assembly 20 advantageously provides minimum obstruction of the rear/side vision for the driver at the driver station S.

For these purposes, the support frame assembly includes a pair of spaced frame units **20*a*, 20*b* (see FIG. 4). Each frame unit 20*a*, 20*b* includes an elongated, upstanding tower support plate 21 positioned a substantial distance to the rear of the driver station S on the rear deck D of the vehicle 10 (see FIGS. 1 and 2). As will be seen later in detail, the tower support plates 21 provide the primary support for the frame assembly 20**.

Attached to the upper end of each tower support plate 21 is an overhead extension plate 22. As best shown in FIGS. 2 and 4, the overhead extension 22 extends toward the front of the vehicle and terminates adjacent the driver station S. At this location, an upstanding support post 23 is provided and connected at its upper end to the extension plate 22.

As can best be seen in FIG. 4, the tower support plate 21 defines a plane P that is purposely directed toward the driver station S. Because of this direction and the narrow profile of the tower support plate 21, there is minimum obstructed area $A_1$ to the rear/side of the vehicle 10.

Figure 3:
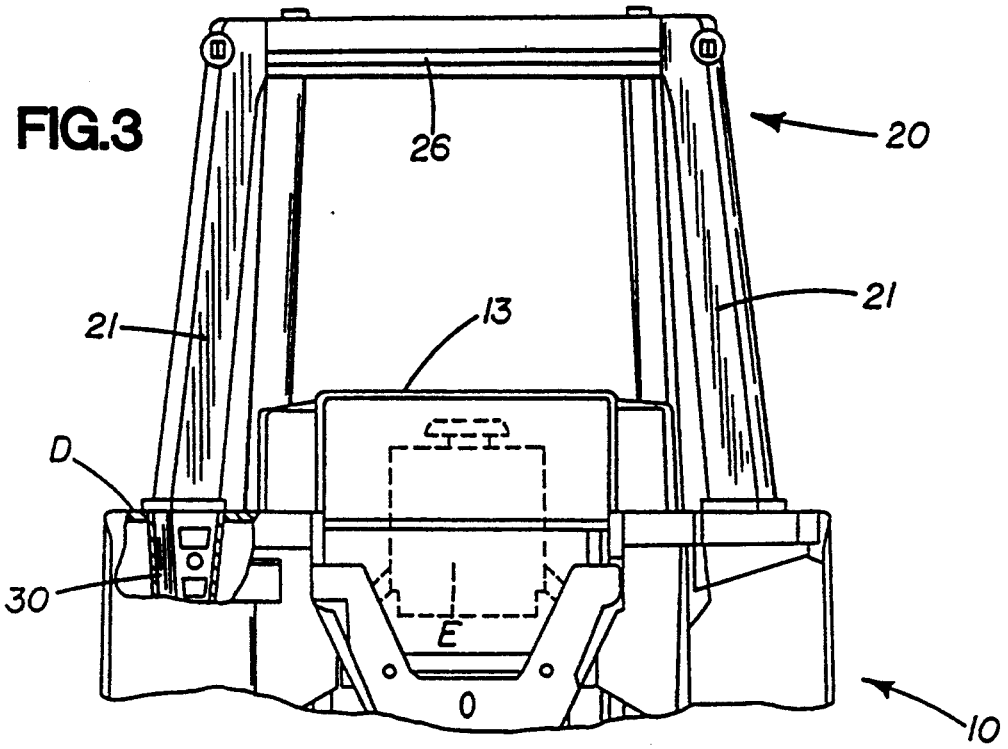
FIG. 3 is a rear view of the vehicle, also with cab removed for clarity, and showing the overhead support frame assembly of the invention as mounted on the deck of the vehicle.

The two frame units 20*a*, 20*b* are tied together by front and rear cross beams 25, 26, respectively to form an exceptionally strong composite frame assembly for resisting the force of the cylinders 15, 16. The primary support comes from the tower supports 21, which slant forwardly toward the extension plates 22 at an approximately 10° angle. The wide foot print, and particularly the positioning of the primary support substantially rearwardly of the attachment point for the cylinders 15, 16 allows the frame assembly 20 to be more efficiently anchored. As best shown in FIG. 3 of the drawings, the tower support plates 21 of each of the frame units 20*a*, 20*b*, are preferably securely seated in a reinforced socket 30 in the deck D.

As shown in FIG. 4, the plane P defined by the elongated tower support plates 21 extend at an approximate 30° angle to the longitudinal axis L of the vehicle 10. With this angle, it can be realized that the driver positioned at the driver station S has maximum vision to the rear, and to the sides of the tower support plates. A full 60° area of vision to the rear is provided.

The upstanding support posts 23 must perform only a secondary support function, and thus may be relatively narrow providing a minimum obstructed view area $A_2$. This is in contrast to the prior art tower posts M, as shown in FIGS. 4*a* and 4*b* of the drawings. These tower posts, as required in the prior art, are relatively wide in order to be strong enough to withstand the substantial force moment that is being applied by the overhead mounted cylinders C. The large obstructed area $A_3$ can thus be seen as a disadvantage, as opposed to the minimum and spaced obstructed areas $A_1$ and $A_2$ of the present invention structure, as shown in FIG. 4.

The frame units 20*a*, 20*b* including the extension plates 22 parallel to the longitudinal axis L of the vehicle, and with the front and rear cross beams 25, 26 perpendicular thereto, form a grid to provide an enhanced falling object protective structure (FOPS). This is gained without providing any additional passive structure, thus substantially increasing the cost/benefit ratio.

Also, by having the anchoring points for the frame units 20*a*, 20*b* spread apart, the rear mounted engine cowling 13 can be easily lifted for access to the engine E. As can be best seen in FIG. 2, this spacing makes maintenance operations and repairs much easier. This should be contrasted with the prior arrangement, as shown in FIGS. 4*a* and 4*b*, where the single tower posts M necessarily are mounted directly in front of the cowling, thus limiting access.

In summary, an overhead support frame assembly 20 is provided by the teachings of the present invention, which frame assembly is more efficient in distributing the reaction force of the tilt cylinders 15, 16. In addition, the frame assembly 20 advantageously provides for minimum obstruction of vision from the driver station S. The two frame units each include an elongated tower support plate 21 anchored on the rear deck of the vehicle 10, an overhead extension plate 22 and an upstanding support post 23 adjacent the driver station S. These tower support plates 21 efficiently provide the primary support. The rear spacing and the 10° forward slant minimizes the force moment and provides for maximum strength. The support post 23 of each frame unit provides only secondary support.

The plane through the tower support plates 21 is directed toward the driver station S so that a minimum profile of the plates 21 obstructs the view to the rear/side of the vehicle (see viewing area $A_1$). The smaller support posts also provide for minimum obstructed viewing area $A_2$. Because the areas $A_1$, $A_2$ are very small in comparison to the obstructed area $A_3$ of the prior art (FIG. 4*b*), and separated from each other, the driver now has virtually unobstructed viewing. Indeed, with just a slight movement of the head, the obstructed areas $A_1$, $A_2$ can be effectively eliminated with the frame assembly 20 of the present invention.

As an additional advantage, easy access to the engine E is provided between the tower support plate 21 and the support post 23 of each frame unit 20*a*, 20*b*. Cross beams 25, 26 connected between the overhead extensions 22 provide enhanced strength and substantially improve the falling object protective structure (FOPS) for the vehicle. In addition, the support posts, 23, are mounted at spaced locations on the rear deck D providing forward support for the frame units, 20*a*, 20*b*, which in combination with the crossbeams, 25, 26, distribute the loading forces more uniformly over a greater footprint on the vehicle frame allowing the frame units, 20*a*, 20*b*, to be of lighter weight construction. The tower support plates, 21, slope forwardly relative to the overhead extension plates, 22. By this construction, part of the loading force is transferred forwardly in a longitudinal direction and then downwardly to the frame as a reaction force at the forward locations, namely at the post, 23, putting them in compression owing to the elbow formed at each corner of the frame units, 20*a*, 20*b*, by the junction of each tower support plate and overhead extension plate, 21, 22. Thus, instead of the upright reaction forces being directed entirely into the truck frame at the rear of the rectangular deck portion defining the footprint area on the rear deck, D, the forces are distributed to the corners of the footprint area at the mounting locations for the frame units, 20*a*, 20*b*, and support posts, 23. As a result, the tower plates, 21, are thinner and pose less of an obstruction to vision when angled toward the operator's station on the diagonal than would otherwise be the case if the upright reaction forces were transferred entirely to the truck frame, as illustrated in the prior art depicted in FIGS. 4*a* and 4*b*, by vertical, heavy pillars, M.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. In a heavy class powered industrial lift truck having a rigid frame, with a front and a rear end, grounded engaging wheels adjacent the front and rear ends of the frame for propelling and maneuvering the truck, a defined yard area in which the truck is operated requiring optimum visibility to the rear during peak hours of operation when traffic conditions are heaviest, a heavy-duty, vertically extending, hydraulically extendable, upright pivotally mounted on the front of the frame and capable of being tilted in a fore and aft manner having an hydraulically elevatable attachment thereon for lifting loads classified as heavy for industrial truck applications and for transporting such loads over considerable distances with the truck travelling in reverse, an engine connected to the wheels at the front of the vehicle for propelling the truck in either forward or reverse directions and for powering the hydraulic system of the truck including the hydraulically operated upright and attachment, a cab area situated to the rear of the upright and attachment providing an operator's station having control means connected to the rear wheels for steering the truck and for manually operating the hydraulic systems of the truck as it is maneuvered in the yard area in either forward or reverse directions, an operator's seat at the operator's station from which an operator controls the raising and lowering of the upright and attachment for lifting and transporting a load thereon and for maneuvering the truck in either forward or reverse directions;

the improvement comprising said hydraulic means including a pair of hydraulic cylinders, generally horizontally mounted, one on each side of the frame, extending longitudinally above the cab area and connected at the forward ends thereof to the upright for tilting it fore and aft from a vertical position, a pair of overhead support frame members, one on either side of the frame, extending upwardly and forwardly over the cab area from mounting locations substantially rearwardly of the cab area providing a solid structural attachment to the frame for transmitting forces encountered by extending or retracting said hydraulic cylinders in tilting the upright and in carrying the heavy loads on the attachment, each said overhead support frame member comprising:

i. an upper, substantially longitudinally extending portion pivotally mounting one of said hydraulic cylinders, and ii. a lower portion angled downwardly and outwardly in a plane approximately through the operator's station relative to said upper portion and extending downwardly therefrom connecting to the frame, said lower portion being substantially wider in the direction of said plane than in the transverse direction and defining an elongated, unitary, heavy plate portion with said upper portion capable of transmitting to the frame a majority of the forces from tilting the upright and in transporting the heavy loads carried on the attachment, and iii. a pair of forward post members, one on each side, supporting the forward ends of each overhead support frame member and distributing a remainder of the forces to the frame at forward spaced locations whereby the overhead support frame members are substantially less of an obstruction to the operator's visibility to the rear.

2. The improvement as set forth in claim 1 wherein said lower portions extend obliquely outwardly generally in vertical planes projecting in a line of sight from the operator's seat generally over the steerable wheels of the truck so as to enhance the operator's view in turning the truck when steering in reverse.

3. The improvement as set forth in claim 1 wherein a cross member extends laterally between the upper portions adjacent the forward ends thereof to provide a rigid structural mounting support for said hydraulic cylinders.

4. The improvement as set forth in claim 2 wherein each said lower portion defines a plane intersecting approximately at the operator's normal head position in said cab area.

5. The improvement as set forth in claim 4 wherein the angle of intersection of said planes is approximately 60 degrees.

6. The improvement as set forth in claim 4 wherein the cab area is fully enclosed by front, side and rear walls, window areas exist in said front, side and rear walls through which the operator has approximately 360 degrees of vision, and where said rear window area provides a viewing area directly over the rear of the truck substantially unobstructed by the overhead support frame members.

7. A heavy-duty lift truck of a heavy industrial load lifting class having a rigid frame with front and rear ends comprising, grounded engaging wheels adjacent the front and rear of the frame for propelling and maneuvering the truck an upright pivotally mounted on the front of the frame and capable of being tilted in a fore and aft manner relative to a vertical plane and being hydraulically extendable in a vertical direction for lifting, carrying and depositing loads that tend to obscure vision to the front when being transported by the truck, an engine mounted toward the rear of the frame connected to the front wheels for propelling the truck, in either a forward or reverse direction, a cab area providing an operator's station on the frame to the rear of the upright, a steering wheel in the cab area, and a seat facing generally forwardly from which the truck is operated in either a forward or reverse direction, a generally rectangular deck portion defining a footprint area behind the cab, a pair of laterally spaced hydraulic cylinders extending longitudinally above the cab area attached at their forward ends to the upright for tilting it in a fore and aft manner, and a pair of laterally spaced overhead support frame members, each having an upper portion supporting a hydraulic cylinder and each member having a lower plate portion extending obliquely in a plane projecting through the operator's station in the cab area and mounted on the frame diagonally at the rear corners of the footprint area, each plate portion having a longitudinal dimension considerably greater than a transverse dimension so as to present an optimally thin obstruction to vision as viewed from the operator's station in turning the truck consistent with the structural support requirements of the overhead support frame members, said lower plate portion of each overhead support frame member transferring loading forces to the vehicle frame by such construction so as to produce a forwardly and downwardly directed reaction force in said upper portion, a pair of front support posts, one on each side, extending between the truck frame and each said upper portion absorbing reaction forces primarily in compression such that the loading forces are distributed to a footprint area larger than they would otherwise be if the loading forces were entirely directed into the frame of the truck by said lower plate portions.

8. A heavy-duty lift truck as set forth in claim 7 wherein each lower plate portion extends on a plane through the operator's station in a direction of about 30 degrees from the upper portion and downwardly toward each rear corner of the footprint area at about 10 degrees to enhance the view in turning the truck.

* * * * *